US005581222A

United States Patent [19]

Pinaud

[11] Patent Number: 5,581,222

[45] Date of Patent: Dec. 3, 1996

[54] SOLENOID VALVE ASSEMBLY WITH RAPID CONNECTION CLIP

[75] Inventor: Donald E. Pinaud, Fort Meyers, Fla.

[73] Assignee: Danfoss Inc., Rockford, Ill.

[21] Appl. No.: 532,428

[22] Filed: Sep. 22, 1995

[51] Int. Cl.[6] ..... H01F 7/00

[52] U.S. Cl. ..... 335/278; 251/129.15

[58] Field of Search ..... 335/251, 255, 335/278; 251/129.15

[56] References Cited

U.S. PATENT DOCUMENTS

| | | | |
|---|---|---|---|
| 3,295,079 | 12/1966 | Brown | 355/255 |
| 3,727,160 | 4/1973 | Churchill | 335/251 |
| 4,055,823 | 10/1977 | Andersen | 335/255 |
| 4,649,360 | 3/1987 | Riefler, et al. | 335/255 |
| 4,805,870 | 2/1989 | Mertz | 251/129.15 |

*Primary Examiner*—Brian W. Brown
*Assistant Examiner*—Raymond M. Barrera
*Attorney, Agent, or Firm*—Lee, Mann, Smith, McWilliams, Sweeney & Ohlson

[57] ABSTRACT

A solenoid valve assembly having a rapid assembly clip. The clip is a spring clip which is pivotally secured to a housing for the solenoid valve assembly. The clip engages an annular groove in an extending portion of a solenoid element, with the clip being appropriately shaped to engage the groove to retain the solenoid element in place in the housing. In the described form of the invention, the spring clip is a wire element which engages the annular groove on opposite sides. Where there is engagement, the wire element is curved to conform to and firmly seat in the annular groove.

8 Claims, 1 Drawing Sheet

SOLENOID VALVE ASSEMBLY WITH RAPID CONNECTION CLIP

BACKGROUND OF THE INVENTION

This invention relates to solenoid valve assemblies, and in particular to a spring clip for providing rapid assembly or disassembly of the solenoid valve assembly.

Various means of providing a rapid assembly or disassembly of a solenoid valve have been disclosed in the past. For example, U.S. Pat. No. 4,055,823, the disclosure of which is incorporated herein by reference, discloses a valve assembly having a cap and nut arrangement for assembling the valve. While this arrangement provides a secure assembly of the solenoid valve, due to the number of parts involved, it can be somewhat costly to manufacture.

U.S. Pat. No. 3,281,740 discloses a different type of assembly device comprising a collar fitted on one end of a solenoid element and a pivotal cap which is secured thereto. Again, due to the number of parts involved, this arrangement can be quite costly to manufacture.

U.S. Pat. No. 4,649,360 discloses another kind of solenoid assembly device comprising a contractible assembly ring which is snapped about a protruding end of a solenoid element. The assembly ring is a molded part, requiring manufacture of a costly mold and, given the nature of the device, close mold tolerances. Such a ring therefore is costly to manufacture.

U.S. Pat. No. 3,295,079 discloses a spring clip for assembling a solenoid valve. The clip engages one end of a solenoid element, and is slid into place to lock the assembly together. It provides an effective means of assembly, although because the clip is a fairly large element, and given the fact that it is made from spring steel, it can be somewhat costly, although not as costly as multipart assembly devices.

U.S. Pat. No. 3,727,160 discloses a retaining clip which is an improvement over that of U.S. Pat. No. 3,295,079. It is simpler, with less metal, and therefore less costly from a materials standpoint. However, it clips only to a protruding end of the solenoid element, and therefore relies on an enlarged portion of a solenoid valve at the opposite end of the solenoid assembly. Otherwise, the element would fall from the solenoid valve assembly when inverted.

SUMMARY OF THE INVENTION

The invention is directed to an improved solenoid valve assembly, where the assembly comprises a solenoid housing having a coil mounted therein, with the coil having a hollow central aperture aligned with corresponding apertures in the housing. An elongated solenoid element extends through the housing and the central aperture, one end of the solenoid element being connected to an actuation member disposed adjacent the housing and the other end of the solenoid element having an attachment portion extending from the housing. Means is provided for securing the solenoid element to the housing, the securing means comprising a spring clip pivotally secured to the housing and an annular groove in the attachment portion. The spring clip is shaped to engage the groove and retain the solenoid element in place.

In accordance with the preferred form of the invention, the spring clip includes a pair of spaced arms, and further includes means resiliently urging the arms toward one another. Preferably, the arms comprise part of a unitary spring clip member, and the means resiliently urging comprises a connecting link of the spring clip member. Each arm includes a curved portion which is shaped to conform to and engage the groove when snapped thereinto.

BRIEF DESCRIPTION OF THE DRAWING

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
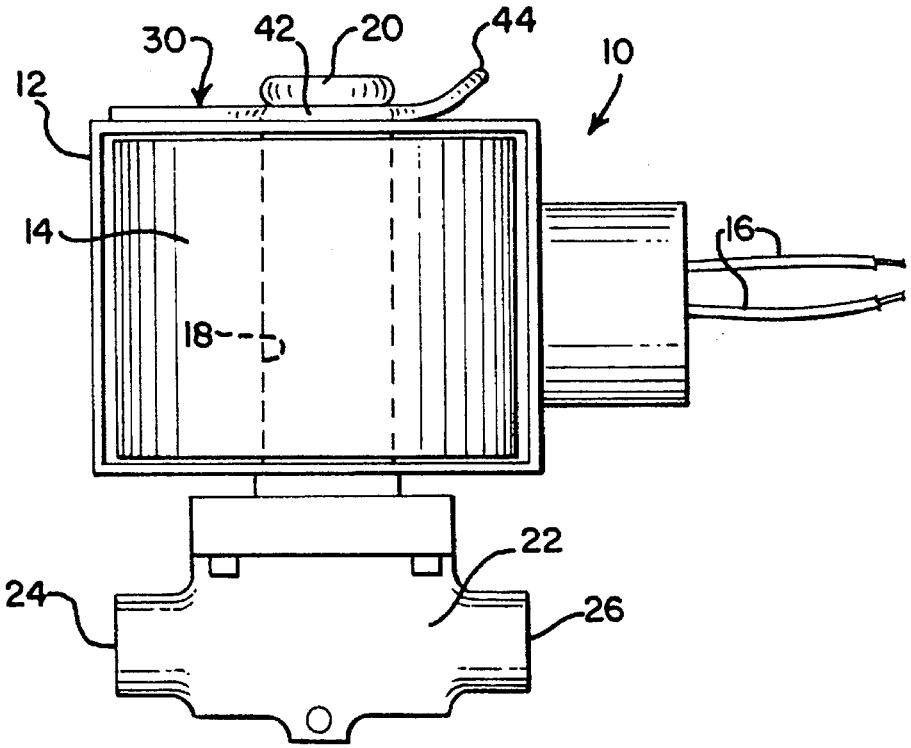
FIG. 1 is a side elevational view of a solenoid valve assembly according to the invention, including the spring clip of the invention.

A solenoid valve assembly 10 according to the invention is shown generally at 10 in the drawing figures. As is conventional, the solenoid valve assembly 10 includes a solenoid housing 12 in which a solenoid coil 14 is mounted. Typically, the housing 12 is made of metal and, as illustrated, surrounds the coil 14. The coil 14 is an electrical winding, activated by electrical energy provided through wires 16 extending from the housing 12 to an appropriate source of electrical energy (not illustrated). The coil 14 can be conventional, having an elongated central aperture 18, and is therefore not described in greater detail.

The solenoid valve assembly includes an elongated solenoid element 20 extending through the central aperture 18 and protruding through corresponding apertures formed in the housing 12. One end of the solenoid element 20 extends beneath the housing 12 and is connected to an actuation member 22 disposed adjacent the housing 12. The actuation member 22 can be a conventional valve which is controlled by actuation of the solenoid valve assembly 10 in a conventional fashion. One end of the actuation member 22, designated at 24, can be a fluid inlet while the other end of the actuation member 22, designated 26, can be a fluid outlet. All of this is conventional, and therefore the actuation member 22 is not described in any greater detail.

The opposite end of the solenoid element 20 includes an annular groove 28. As will be evident, the groove 28 protrudes just above the housing 12 for assembly purposes, as described immediately below.

For securing the solenoid element to the housing 12, the solenoid valve assembly 10 includes a wire spring clip 30 which is pivotally secured to the housing 12. The spring clip 30 includes legs 32 and 34 which protrude through small holes 36 and 38 in the housing 12. The legs 32 and 34 extend into the holes 36 and 38 and then turn toward one another so that the spring clip 30 is pivotal relative to the housing 12.

The spring clip 30 has opposite spaced arms 40 and 42 engaging the annular groove 28. As illustrated, the arms 40 and 42 are curved to conform to the annular groove 28 so that when the spring clip 30 is snapped onto the solenoid element 20, the arms 40 and 42 are securely seated in the annular groove 28.

Figure 2:
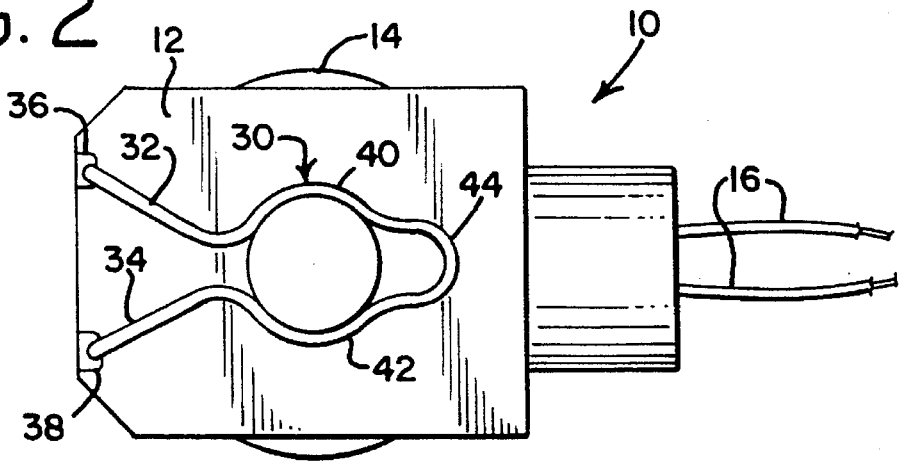
FIG. 2 is a top plan view of the solenoid valve assembly of FIG. 1, showing the new spring clip.
Figure 3:
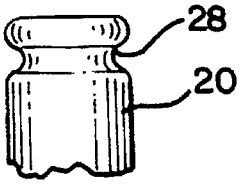
FIG. 3 is an elevational view of one end of the elongated solenoid element used in the solenoid valve assembly of FIGS. 1 and 2, and clearly illustrating the annular groove formed in that one end.

The arms 40 and 42 are resiliently urged toward one another by means of a connecting link 44 of the spring clip 30 which, as best illustrated in FIG. 1, is upturned relative to the housing 12 for ease of manipulation of the spring clip 30. By grasping the link 44 and prying it upwardly in relation to the housing 12 in FIG. 1, the solenoid valve assembly 10 is disassembled. Assembly is accomplished by simply rotating the spring clip 30 to the orientation shown in FIGS. 1 and 2 while engaging the annular groove 28. In this fashion, the solenoid valve assembly 10 can be rapidly assembled or disassembled by simple manipulation of the spring clip 30.

It is preferred that the spring clip 30 be made of spring steel or another similar material which is resilient and therefore will resiliently engage the annular groove 28 of the solenoid element 20. Other materials, such as similar plastics, can also be used, as will be apparent to one skilled in the art.

The spring clip 30, being connected to the housing 12, provides a unique means of a formation of the solenoid valve assembly 10. Because the spring clip 30 is secured to both the housing 12 and, when assembled, to the annular groove 28 of the solenoid element 20, no matter what type of actuation member 22 is employed, and no matter whether or not the actuation member 22 is immediately adjacent to the housing 12, the spring clip 30 retains the solenoid element 20 in place no matter what the orientation of the solenoid valve assembly may be. Thus, unlike the prior art assembly devices described above, even if the actuation member 20 is not present or is spaced a considerable distance from the housing 12, the solenoid element 20 remains firmly in place, even if the solenoid valve assembly is inverted.

Various changes can be made to the invention without departing from the spirit thereof or scope of the following claims.

What is claimed is:

1. A solenoid valve assembly, comprising a. a solenoid housing having a coil mounted therein, the coil having a hollow central aperture aligned with corresponding apertures in said housing, b. an elongated solenoid element extending through said housing and said central aperture, one end of said solenoid element being connected to an actuation member disposed adjacent said housing and the other end of said solenoid element having an attachment portion extending from said housing, and c. means for securing said solenoid element to said housing, said securing means comprising i. a spring clip, said spring clip being pivotally secured at one end of said spring clip to said housing; and ii. an annular groove in said attachment portion, said spring clip being shaped to engage said groove when said solenoid element is located in said housing.

2. A solenoid valve assembly according to claim 1 in which said spring clip includes a pair of spaced arms, and further including means resiliently urging said arms toward one another.

3. A solenoid valve assembly according to claim 2 in which said arms comprise part of a unitary spring clip member, and in which said means resiliently urging comprises a connecting link of said spring clip member.

4. A solenoid valve assembly according to claim 3 in which each arm includes a curved portion shaped to conform to and engage said groove.

5. In a solenoid valve assembly having a solenoid housing with an activation coil mounted therein and a removable solenoid element formed to be installed in the coil and protruding from the housing, the improvement comprising means for securing the solenoid element to the housing, the securing means comprising a. a wire spring clip having one end pivotally secured to said housing, and b. an annular groove in one end of said solenoid element, said spring clip being shaped to engage and snap into said groove when said solenoid element is located in said housing.

6. A solenoid valve assembly according to claim 5 in which said spring clip includes a pair of spaced arms, and further including means resiliently urging said arms toward one another.

7. A solenoid valve assembly according to claim 2 in which said means resiliently urging comprises a connecting link of said wire spring clip.

8. A solenoid valve assembly according to claim 6 in which each arm includes a curved portion shaped to conform to and engage said groove.

* * * * *